United States Patent [19]

Beer et al.

[11] Patent Number: 4,585,540

[45] Date of Patent: Apr. 29, 1986

[54] COMPOSITE CATALYTIC MATERIAL PARTICULARLY FOR ELECTROLYSIS ELECTRODES AND METHOD OF MANUFACTURE

[75] Inventors: Henri B. Beer, Heide-Kalmthout; Frans A. M. Van den Keybus, Essen, both of Belgium; Jeries I. Bishara, Mentor; William A. Kovatch, Painesville, both of Ohio; Jean M. Hinden, Chambésy, Switzerland

[73] Assignee: ELTECH Systems Corporation, Boca Raton, Fla.

[21] Appl. No.: 689,134

[22] Filed: Jan. 7, 1985

[30] Foreign Application Priority Data

Sep. 13, 1984 [EP] European Pat. Off. ..... 84810446.9

[51] Int. Cl.[4] ..... C25B 11/00; H01M 4/88

[52] U.S. Cl. ..... 204/290 F; 502/101; 502/325; 502/339

[58] Field of Search ..... 204/290 F; 502/101, 502/325, 339

[56] References Cited

U.S. PATENT DOCUMENTS

| | | | |
|---|---|---|---|
| 3,234,110 | 2/1966 | Beer | 204/38 |
| 3,632,498 | 2/1968 | Beer | 204/290 |
| 3,684,543 | 8/1972 | deNora et al. | 117/2 |
| 3,711,385 | 1/1973 | Beer | 204/59 |
| 3,773,554 | 11/1973 | Scrutton et al. | 117/215 |
| 3,773,555 | 11/1973 | Cotton et al. | 117/217 |
| 3,869,312 | 3/1975 | Moss et al. | 117/215 |
| 3,882,002 | 5/1975 | Cook | 204/98 |
| 3,948,751 | 4/1976 | Bianchi et al. | 204/290 |
| 3,950,240 | 4/1976 | Cookfair et al. | 204/290 |
| 4,039,400 | 8/1977 | Hayfield | 204/38 |
| 4,140,813 | 2/1979 | Hund et al. | 427/34 |
| 4,203,810 | 5/1980 | Warne et al. | 204/38 |
| 4,206,020 | 6/1980 | Backhurst et al. | 204/59 |
| 4,223,049 | 9/1980 | Murray et al. | 427/126 |
| 4,272,354 | 6/1981 | deNora et al. | 204/290 |
| 4,331,528 | 5/1982 | Beer et al. | 204/290 |
| 4,381,290 | 4/1983 | Hardee | 204/290 F |
| 4,425,217 | 1/1984 | Beer | 204/290 |
| 4,446,245 | 5/1984 | Hinden | 502/101 |
| 4,456,518 | 6/1984 | Bommaraju | 204/290 F |

FOREIGN PATENT DOCUMENTS

| | | |
|---|---|---|
| 0065819 | 12/1982 | European Pat. Off. . |
| 0081251 | 6/1983 | European Pat. Off. . |
| 0090425 | 10/1983 | European Pat. Off. . |
| 0099866 | 2/1984 | European Pat. Off. . |
| 83/03265 | 9/1983 | PCT Int'Appl. . |
| 1346369 | 2/1974 | United Kingdom . |
| 1531373 | 11/1978 | United Kingdom . |
| 1344540 | 3/1982 | United Kingdom . |

*Primary Examiner*—John F. Niebling
*Attorney, Agent, or Firm*—John J. Freer

[57] ABSTRACT

A porous high surface area composite electroconductive catalytic material, particularly as electrocatalyst for electrolysis electrodes, comprises a porous pre-formed matrix which is a catalytic mixed crystal material of at least one platinum group metal oxide and at least one valve metal oxide throughout which a subsequently-added additional catalyst preferably consisting of at least one platinum group metal and/or oxide is dispersed by chemideposition in an oxidizing or reducing atmosphere preferably followed by an annealing post heat treatment. The porous matrix may be ruthenium-titanium oxide and the additional catalyst advantageously comprises at least two oxides of ruthenium, rhodium, palladium and iridium, other combinations being possible.

20 Claims, No Drawings

COMPOSITE CATALYTIC MATERIAL PARTICULARLY FOR ELECTROLYSIS ELECTRODES AND METHOD OF MANUFACTURE

TECHNICAL FIELD

The invention relates to a porous high surface area composite electroconductive catalytic material particularly suitable for use in electrolytic processes as well as methods of producing this material and electrolysis electrodes comprising this material as electrocatalyst e.g. as an electrocatalytic coating. The invention also relates to the renewal of coatings on dimensionally stable electrolysis electrodes. It further relates to methods of electrolysis in which the reaction is catalyzed by this material e.g. the electrolytic production of halogens especially chlorine, hypochlorite and chlorate, metal electrowinning processes and so forth.

BACKGROUND ART

The most important development in electrolysis electrodes in recent years has been the advent of so-called dimensionally stable anodes following the teachings of U.S. Pat. Nos. 3,771,385 and 3,632,498. The most successful electrocatalytic coatings for such anodes have been those consisting of a mixed oxide of a platinum-group metal and a valve metal forming a mixed crystal or solid solution in which the precious metal oxide is stabilized without detriment to its catalytic characteristics. These coatings, in particular ruthenium-titanium oxide coatings, have been especially successful in chlorine production in mercury cells, diaphragm cells and, more recently, in membrane cells.

The above patents and many others have described multicomponent electrode coatings in which thermodecomposable compounds of the components are mixed in a solution which is repeatedly applied to the electrode substrate, dried and converted to the multicomponent coating by baking. In this way, it is for example possible to provide electrodes with an outstanding lifetime per gram of precious metal employed, as described in U.S. Pat. No. 3,948,751, or electrodes with ion-selective properties for halogen evolution and oxygen inhibition as described in U.S. Pat. No. 4,272,354.

Multilayer electrode coatings produced by building up alternate layers of different materials have also been proposed. For instance, U.S. Pat. No. 3,773,554 describes alternate layers of ruthenium oxide and titanium oxide and U.S. Pat. No. 3,869,312 describes alternate layers of a ruthenium-titanium mixed oxide material and of titanium oxide.

It has also been proposed to anchor or embed an electrochemically active material in an inert layer typically consisting of a layer of titanium oxide on a titanium substrate. Early proposals were to form this layer by heating a titanium substrate in air or by anodic oxidation of a titanium substrate as described in U.S. Pat. No. 3,234,110. A later proposal was to electrocoat Ti with titanium oxide from a solution containing $Ti^{4+}$ ions, see U.S. Pat. No. 3,773,555 and 4,039,400. These proposals and their drawbacks are discussed in U.S. Pat. No. 4,140,813 which set out to improve the resistance of the electrode coatings to contact with mercury amalgam by plasma spraying a layer of titanium oxide in the pores of which an active electrode material is anchored.

U.S. Pat. No. 4,223,049 discloses an electrode with a conductive base having a coating of titanium oxide or tin oxide into which ruthenium oxide is superficially mixed by immersion/washing/baking without forming a separate outer layer of ruthenium oxide.

Various proposals have also been made in which an outer layer of electrochemically active material is deposited on a sub-layer of an active material which serves primarily as a conductive intermediate to protect the substrate. For example, U.K. Pat. No. 1,344,540 provided an electrodeposited layer of cobalt oxide or lead oxide under a ruthenium-titanium oxide or similar active outer layer. Various tin oxide based sub-layers are disclosed in U.S. Pat. No. 4,272,354, 3,882,002 and 3,950,240, once again a coated with the same type of active outer layer. U.S. Pat. No. 4,331,528 made an important improvement in this area by developing a preformed barrier layer formed as a surface oxide film integral with and grown up from the valve metal substrate with simultaneous incorporation of a small quantity of rhodium or iridium as metal or oxide in the surface oxide film, the active coating being subsequently deposited on top.

Along similar lines, Japanese Patent publication 028262/78 provided an undercoating of an oxide of ruthenium, tin, iridium or rhodium on a valve metal substrate, and an active outer coating of palladium oxide or a mixture of palladium oxide and ruthenium oxide. In Japanese Patent publication 115282/76, a spinel-type underlayer consisting preponderantly of $Fe_2O_3$ with other non-precious oxides was coated with a top-layer of precious metal oxides.

U.S. Pat. No. 4,203 810 has proposed to electroplate a relatively thick layer of a platinum group metal onto an undercoat of a chemideposited platinum-group metal or oxide. The converse arrangement is described in published European patent application No. 0,090,425, in which an oxide of ruthenium, palladium or iridium is chemideposited into a porous layer of platinum electroplated onto an electrically-conductive substrate.

Other proposals for intermediate layers have included an underlayer of ruthenium, rhodium or palladium oxide to which an outer layer of a preformed spinel was attached by means of a binder, see U.K. Pat. No. 1,346,369 and a platinum-iridium undercoat topcoated with a composite containing lead, ruthenium, tantalum, platinum, iridium and oxygen, see Published PCT Patent Application W083/03265.

The prior art discussed above concerns coating formulations intended for the production of new electrodes. It is also known to renovate previously-used dimensionally stable anodes by cleaning the old coating and applying on top a new coating of similar composition, see U.S. Pat. No. 3,684,543. Recently, this so-called top coating procedure has been improved by an activation of the old coating prior to application of the new outer electrocatalytic coating, as described in U.S. Pat. No. 4,446,245. In this case, the activated old coating serves as a base for the new coating. Thus, the teaching of this patent is confined solely to the recoating of previously-used electrodes.

The above-mentioned electrocatalysts are generally coated onto a massive substrate such as a sheet of valve metal, one common configuration being an expanded mesh. Other arrangements are however possible. For example, the electrocatalyst can be particulate or can be supported on particles of suitable material such as a valve metal and these particles may then be applied to a conductive lead substrate (see U.S. Pat. No. 4,425,217) or may be incorporated in a narrow gap electrolysis cell e.g. by bonding to a membrane as disclosed in European Patent Application No. 0,081,251, or they may be used in a fluidized bed electrochemical cell (see U.S. Pat. No. 4,206,020). Other substrate configurations include wires, tubes, perforated plates, reticulated structures and so forth.

Electrodes with catalytic coatings of the types described above may be used in various electrolytic processes. Typically they are used as anodes in chlor-alkali cells or as oxygen evolving anodes e.g. in metal electrowinning processes. Their use as cathodes in various processes has also been proposed, e.g. for the production of chlorine dioxide, as disclosed in European Patent Application No.0 065 819. The latter patent application also proposed the same materials as heterogeneous catalysts for the non-electrochemical production of chlorine dioxide. Typical catalysts for this application included codeposited oxides of ruthenium/rhodium, ruthenium/rhodium/palladium and ruthenium/palladium usually codeposited with a matrix of titanium dioxide. The catalysts were usually deposited on a titanium substrate but other supports such as alumina were also proposed.

European Patent Publication No. 0099866 describes a catalyst for the oxygen evolution reaction in water electrolysis. This catalyst comprises a host matrix of a transition element namely cobalt, nickel or manganese which incorporates one or more modifier elements deposited for example by vacuum sputtering and then subjected to a heat treatment or an electrochemical treatment. Improved activity is claimed in relation to a nickel anode.

It is also known from U.K. Pat. No. 1,531,373 to place, in the anode compartment of a diaphragm cell, a non-polarized titanium mesh or a polymer lattice coated with a catalytic material such as ruthenium-titanium oxide which functions to catalyze the decomposition of hypochlorite ions.

Thus, broadly speaking, from the prior art discussed above it is known to have a porous high surface area electroconductive catalytic material comprising at least one platinum group metal and/or at least one platinum group metal oxide which is applied to a support, advantageously a porous pre-formed matrix e.g. of titanium oxide. Also, broadly known from the prior art is a porous high surface area electroconductive catalytic material comprising a porous preformed catalytic matrix supporting a subsequently-applied additional catalyst.

In many standard applications such as electrode coatings for chlorine production in diaphragm cells and mercury cells, the known catalytic materials have proven to be outstanding in their performance and cost effectiveness. However, for some applications it still remains desirable to improve the performance without this being offset by a prohibitive cost due either to a high cost of the catalyst or a high production cost or a combination of these.

For example, it would be desirable to provide an economical anode coating with enhanced resistance to caustic for use in membrane cells. Also, there is a need for an economical anode coating with high chlorine selectivity (i.e. selective inhibition of oxygen evolution) for use in dilute chloride solutions, in chlorate production cells or seawater electrolysis. There is also a need for an anode coating with low oxygen overpotential and long life in sulphuric acid for metal electrowinning from sulphate solutions. And in some mercury cell plants where operating conditions are particularly severe it would be desirable to improve the resistance of the anode coatings to contact with amalgam.

SUMMARY OF THE INVENTION

As set out in the claims, the invention provides a porous high surface area composite electroconductive catalytic material comprising a porous pre-formed matrix throughout which is dispersed at least one subsequently-applied platinum-group metal and/or at least one platinum-group metal oxide. The composite catalytic material has an outer face which in use is in contact with a fluid medium, typically an aqueous electrolyte. According to the invention, the porous matrix is a catalytic material comprising at least one platinum-group metal oxide and at least one non-precious metal oxide mixed intimately in a porous high surface area structure. The applied platinum group metal and/or oxide is carried by this structure as a thin, discontinuous layer whereby both (a) the platinum-group metal oxide of the preformed matrix and (b) the applied platinum group metal and/or oxide which are disposed inside the structure are exposed through the pores of the composite electrocatalytic material to the medium contacting the outer face of the composite catalytic material. Such a thin layer of the subsequently-applied catalyst will typically be non-uniformly distributed in the matrix. Also, it may partly be integrated or diffused into the matrix.

Another aspect of the invention is a porous high surface area composite electroconductive catalytic material comprising a porous preformed catalytic matrix and a subsequently-applied additional catalyst dispersed throughout and supported by the preformed matrix, wherein:

(a) the preformed matrix is a mixed catalytic material comprising at least one platinum-group metal oxide mixed intimately with at least one non-precious metal oxide in a porous high surface area support structure, preferably as a mixed-crystal with the non-precious metal oxide present in an amount of at least 50 mol %;

(b) the subsequently-applied additional catalyst is a modifier catalyst which is of different composition to the mixed catalytic material of the preformed matrix, notably the additional catalyst is predominantly of catalytic material (usually, more than 90% by weight and preferably more than 95% by weight of catalytic material), and (c) the subsequently-applied additional catalyst is carried by the preformed matrix as a thin discontinuous layer non-uniformly distributed in the porous high surface area support structure whereby the mixed catalytic material of the preformed matrix located within the high surface area support structure is exposed through discontinuities of the subsequently-applied additional catalyst to external media.

In this composite catalytic material the porous matrix advantageously consists essentially of a mixed crystal material of rutile structure, for example ruthenium-titanium oxide (e.g. in a mol ratio of about 1:1 to 1:3, or even down to 1:10), ruthenium-titanium-tin oxide (e.g. in a mol ratio of about 1:2-5:0.5-1, ruthenium-tin oxide, ruthenium-manganese oxide (e.g. in a mol ratio of about 1:2 to 1:9), iridium-tantalum oxide (e.g. in a mol ratio of about 1.9:1 to 5.5:1) and so forth. Generally, these mixed crystal materials will contain 10–50 and preferably 15–45 mol % of the platinum-group metal oxide(s) and the balance non-precious metal oxides. These mixed crystal materials are produced by codeposition of the components and form a single crystalline phase of rutile structure. However, the material may include minor or trace amounts of codeposited oxides finely dispersed in the mixed crystal material but forming a separate crystalline phase. Such separate codeposited oxides may be an excess of one of the components of the mixed crystal material, or may be a separate component such as a dopant. The porosity of codeposited mixed crystal materials is non-uniform and in practice these materials have a so-called mud-cracked appearance. It is this non-uniform porosity which provides the mixed crystal materials with an exceptionally high surface area.

Advantageously, the mixed crystal material of the porous matrix is a coating keyed to the surface of a valve metal base prior to incorporation of the applied platinum-group metal and/or oxide. By "valve metal" is meant titanium, zirconium, niobium, tantalum and tungsten and, as far as the base is concerned, this term is also meant to cover alloys of these metals or of at least one of these metals with another metal or metals which when connected as anode in an electrolyte in which the coated base is subsequently to operate as anode, there rapidly forms a passivating oxide film protecting the underlying metal from corrosion by the electrolyte. For most applications, titanium will be the preferred base material.

For the manufacture of new electrodes according to the invention, the porous matrix is formed by codepositing thermally decomposable platinum-group metal and non-precious metal compounds onto a valve metal base and baking in an oxidizing atmosphere to produce a porous coating preferably having a thickness corresponding to at least about 5 g/m$^2$ of the platinum group metal plus non-precious metal.

However, the invention also applies to the renewal of used electrodes and in this case the porous matrix consists of a used electrocatalytic coating of a dimensionally stable electrolysis electrode.

Unexpectedly good results have been obtained when the porous mixed crystal material is used as a high surface area host matrix to support a subsequently-added additional catalyst in accordance with the claims, usually a thin layer of platinum-group metal and/or oxide. It is believed that the catalyst(s) of the mixed crystal material and the subsequently-applied additional catalyst(s) act as it were in tandem since the increase in performance is usually a multiple of the performance one would expect from the individual catalysts operating separately. It seems likely that the high surface area of the porous mixed crystal host matrix maximizes the effectiveness of the additional or auxiliary catalyst while at the same time the effect of the catalyst in the porous matrix is sustained. For most catalyst combinations, the synergistic effect is increased by an annealing treatment discussed in detail below; it therefore seems likely that a prolonged heat treatment modifies the mode of incorporation/distribution of the additional catalyst in the host matrix. However, the Applicants do not wish to be bound by any theories in these respects.

When a single additional catalyst is used, rhodium oxide, palladium oxide, iridium oxide and platinum metal have all given very good results when added to a porous matrix based on ruthenium oxide, e.g. ruthenium-titanium oxide.

Excellent results have been obtained with one type of combination in which the applied component comprises platinum metal and at least one oxide of rhodium, palladium and iridium with ruthenium oxide as an optional third component.

In another type of combination that has produced outstanding results, the applied component comprises at least two oxides of ruthenium, rhodium, palladium and iridium. The best results to date have been obtained with the following combinations on a ruthenium-titanium oxide matrix (or a ruthenium-tin oxide matrix): rhodium-palladium oxides, rhodium-palladium-iridium oxides, rhodium-iridium oxides, ruthenium-rhodium oxides, palladium-iridium oxides, and ruthenium-palladium-iridium oxides. The four oxides may of course also be combined in various proportions.

In one advantageous embodiment, the additional catalyst is composed of rhodium-palladium oxides ranging from 95:5 to 5:95 weight % rhodium to palladium.

Another excellent additional catalyst combination is ruthenium-rhodium oxides having 10–40% ruthenium and 60–90% rhodium by weight of the metals.

In another advantageous embodiment, the additional catalyst is composed of ruthenium-palladium-iridium oxides containing from 50–90% ruthenium, 5–25% palladium, and 5–5% iridium, all by weight of the metals.

Yet another advantageous combination of additional catalysts is rhodium-palladium-iridium oxides in the ratio 50–90% rhodium, 5–25% palladium and 5–25% iridium, all by weight of the metals.

Generally speaking, the additional catalyst will be valve-metal free and in any event the additional catalyst will consist of at least 90% and advantageously 95% or more by weight of catalytic materials, i.e., specifically excluding any significant amount of inert materials such as valve metal oxides. In addition to the platinum-group metals and/or platinum group metal oxides it will in some instances be advantageous to incorporate non-precious catalytic material such as the oxides of cobalt, nickel, iron, lead, manganese and tin or tin/bismuth, tin/antimony in the subsequently-applied additional catalysts. Incorporation of these catalytic non-precious metal oxides in the additional catalyst is particularly advantageous when mixed or combined with at least one platinum group metal and/or oxide.

Another aspect of the invention consists of the composite catalytic material wherein the porous matrix is a catalytic mixed crystal material comprising at least one platinum-group metal oxide and at least one co-formed non-precious metal oxide forming a porous high surface area coating on a valve metal base, the subsequently-applied platinum group metal and/or oxide being dispersed in this structure by chemideposition from an essentially non-precious metal free solution of at least one thermodecomposable platinum-group metal compound followed by annealing whereby both (a) the platinum-group metal oxide of the preformed matrix and (b) the applied platinum group metal and/or oxide disposed inside the structure are exposed through the pores of the composite electrocatalytic material to the medium contacting the outer face of the composite catalytic material.

The electroconductive catalytic materials described above may be produced by:

providing a porous matrix which is a catalytic material comprising at least one platinum-group metal oxide and at least one non-precious metal oxide mixed intimately in a porous high surface area structure, preferably a mixed crystal material of rutile structure;

impregnating the porous matrix with either an essentially non-precious metal free solution containing at least one thermodecomposable platinum-group metal compound or, more broadly, a solution containing compounds which are decomposable to form a modified catalyst of different composition to the mixed catalytic material of the porous matrix, the modifier catalyst containing at least 90% by weight of a catalytic material; and heat treating the impregnated porous matrix to convert the compound(s) to at least one platinum-group metal and/or oxide or other modifier catalyst dispersed throughout the porous matrix.

The heat treatment may take place in an oxidizing atmosphere such as air or in controlled non-oxidizing or partially oxidizing conditions i.e. in a reducing, inert or mildly oxidizing atmosphere such an ammonia-air mixture or a nitrogen-hydrogen mixture. A reducing agent may also be included in the solution. Each applied coat is subjected to a short heat treatment to convert the compound(s) to the metal and/or oxide and after application of the final coat the heat treatment is preferably completed by annealing in air at a temperature of from 300° to 600° C. for up to 100 hours. Excellent results have been obtained with such a post heat treatment at 450°-500° C. for from 2-30 hours.

For many additional catalysts this post heat treatment has been found to provide a remarkable increase in performance. This is sometimes linked with baking in non-oxidizing or partial oxidizing conditions whereby the additional catalyst is initially formed as a metal or a partly oxidized metal, especially for additional catalysts including palladium. In this case the post heat treatment in air serves to oxidize or to complete oxidation of the additional catalyst. However, the post heat treatment is also beneficial when the additional catalyst is initially formed in oxidizing conditions and may already be completely oxidized.

The effect of this post heat treatment is quite surprising since the same beneficial effect is not observed to the same degree with standard coatings comprising one or more platinum-group metal oxides codeposited with a valve metal oxide as a mixed crystal.

Thus, the post heat treatment has an annealing effect which in some instances is associated with a distribution or equalization of the additional catalyst in the matrix. Without post heat treatment there may be a pronounced non-uniform distribution of the additional catalyst with greater density of the auxiliary catalyst near the surface. After post heat treatment, the additional catalyst is more uniformly distributed (but rarely entirely uniformly distributed) in the matrix. Therefore, one of the characteristics of most composite catalytic materials of the invention is a non-uniform distribution of the additional catalyst throughout the thickness of the material.

When the composite catalytic material of the invention is to be used in particulate form, e.g. in a so-called solid polymer electrolyte (SPE) cell or in a fluidized bed cell, the method of the invention may comprise first forming porous matrix particles of an electrocatalytic mixed crystal material of at least one platinum group metal oxide and at least one non-precious metal oxide for example by spraying a solution of thermodecomposable compounds of the components into air heated to about 400°-500° C. in a conventional spray drying apparatus, or alternatively using coprecipitation techniques.

The matrix particles are then mixed into a solution of thermodecomposable compounds of the auxiliary catalysts, dried in a conventional particle drying apparatus and heated in air or a reducing atmosphere, optionally followed by a prolonged heat treatment as outlined above. Alternatively, support particles of various materials such as film-forming metals can be coated with an electrocatalytic mixed crystal material of a platinum group metal oxide and at least one non-precious metal oxide forming a porous matrix for a subsequently added catalyst for example one or more of the oxides of ruthenium, rhodium, palladium and iridium. These catalytic particles, and in particular those with favourable properties for oxygen evolution from acid electrolytes, may then for example be present into a supporting lead substrate as disclosed in U.S. Pat. No. 4,425,217. Alternatively, they may be incorporated in a narrow gap electrolysis cell e.g. by bonding to a membrane, as disclosed in European Patent Publication No. 0,081,251.

A further aspect of the invention is a catalytic electrolysis electrode comprising as electrocatalyst the catalytic material as set out above and in the claims or as produced by the methods as set out above and in the claims.

The invention also pertains to a method of renewing a used coating of a dimensionally stable electrolysis electrode having a valve metal base and a porous electrocatalytic coating comprising at least one oxide of a platinum-group metal and at least one non-precious metal oxide without recoating the electrode with a similar new coating. This method comprises impregnating the porous used coating with an essentially non-precious metal free solution containing at least one thermodecomposable platinum-group metal compound. The impregnated porous coating is then heated to convert the compound(s) to at least one platinum-group metal and/or oxide dispersed throughout the porous coating.

An alternative method of renewing the used coating of a dimensionally stable electrolysis electrode of the type having a valve metal base and a porous electrocatalytic coating comprising at least one oxide of a platinum-group metal and at least one non-precious metal oxide comprises impregnating the porous used coating with an essentially non-precious metal free solution containing at least one thermodecomposable platinum-group metal compound and heat treating the impregnated porous coating in a non-oxidizing or partially oxidizing atmosphere followed by annealing in air at a temperature of from 300° to 600° C. for up to 100 hours to convert the compound(s) to at least one platinum-group metal and/or oxide dispersed throughout the porous coating. The electrode with the thus activated coating can then be used for electrolysis, or it is possible to apply on top a new coating of similar composition to the old one, as taught in U.S. Pat. No. 4,446,245.

Such methods of renewal find particular advantage when it is decided to convert a chlor-alkali diaphragm cell to the ion-exchange membrane process.

Dimensionally stable anodes renewed by the methods set out above constitute another aspect of the invention.

Finally, the invention also pertains to a method of electrolysis wherein electrolysis current is passed between electrodes in an electrolyte, at least one of the electrodes including a porous catalyst having an outer face in contact with the electrolyte, wherein the catalyst is the catalytic material as set out above and in the claims or as produced by the methods set out above and in the claims. More specifically, a particularly advantageous application of the invention is the production of chlorine/caustic in an ion-exchange membrane cell using anodes having catalytic coatings produced by renewing or converting the coatings of diaphragm-cell anodes as set out above.

BEST MODES OF CARRYING OUT THE INVENTION

The invention will be further described in the following Examples.

EXAMPLE 1

Titanium coupons measuring approximately 20×100×1.5 mm were degreased, rinsed in water, dried, etched for 6 hours in 10% oxalic acid at 95° C., and then washed in water. They were then coated with a solution of 6 ml n-propanol, 0.4 ml HCl (concentrated), 3.2 ml butyl titanate and 1 g $RuCl_3$. In all, five coats were applied, each coat being heated in air at 500° C. for ten minutes. This produced electrodes with a ruthenium-titanium oxide mixed crystal coating in an approximately 30/70 mol ratio and containing approximately 8 g/m$^2$ of ruthenium. The mixed crystal coating had porous mud-cracked configuration and was used as host matrix for additional catalysts as follows.

The porous mixed crystal coatings were impregnated with a solution containing various quantities of rhodium chloride and/or palladium chloride in 10 ml isopropyl alcohol, 0.4ml HCl (37%) and 10 ml of linalool. Four applications were made and after each impregnation the electrodes were heated in an ammonia-air mixture (or, in the case of electrodes #53 and #31, in a nitrogen-hydrogen mixture or in air) at 500° C. for ten minutes. Then the electrodes were submitted to a final heat treatment in air for 20 hours at 500° C. This produced coatings with a ruthenium-titanium oxide matrix throughout which rhodium oxide and/or palladium oxide was distributed. The amount of the additional catalyst corresponded to approximately 5 g/m$^2$ of rhodium and/or palladium for each electrode. The amounts of rhodium and palladium in each electrode are shown in Table 1. The electrodes were then subjected to the following tests and the results are shown in Table 1.

Test Procedures

The electrodes were subjected to accelerated lifetime tests (a) in 180 g/l $H_2SO_4$ without external heating i.e. at about 30° C. and at an anode current density of 15 kA/m$^2$ and (b) in 30% NaOH at 95°–96° C. and at an anode current density of 28 kA/m$^2$. The electrode lifetimes under current reversal conditions (polarity inversion every 2 minutes) were measured at an anode current density of 20 kA/m$^2$ (a) in 180 g/l $H_2SO_4$ at 30° C. and (b) 25% NaCl at 80° C. and pH 3–4. All of these lifetimes are given in hours in the Tables.

The half-cell potentials for oxygen and chlorine evolution were measured at an anode current density of 5 kA/m$^2$ in 180 g/l $H_2SO_4$ and in 25% NaCl of pH 2–3, both at 80° C. The measured values were related to a normal hydrogen electrode (NHE) and are reported in Table 1 in millivolts. These values have not been corrected for ohmic drop.

TABLE 1

| | Added Catalysts | Accelerated Life (hours) | | Current Reverse (hours) | | Half-Cell Potential (vs NHE) mV | |
|---|---|---|---|---|---|---|---|
| Ref. | Rh/Pd | $H_2SO_4$ | NaOH | $H_2SO_4$ | NaCl | $O_2$ | $Cl_2$ |
| #54 | 0/5 | 82 | 99 | 8 | 16 | 1640 | 1320 |
| #1 | 1.5/3.5 | 270 | 84 | 8 | 15 | 1600 | 1320 |
| #62 | 3/2 | 246 | 109 | 10 | 41 | 1640 | 1320 |
| #6 | 4/1 | 630 | 98 | 12 | 21 | 1590 | 1320 |
| #5 | 4.5/0.5 | 505 | 106 | 16 | 43 | 1650 | 1320 |
| #27 | 5/0 | 235 | 88 | 10 | 52 | 1610 | 1320 |
| #53 | 5/0 | 244 | 106 | 13 | 60 | 1660 | 1320 |
| #31 | 5/0 | 201 | 94 | 12 | 85 | 1630 | 1320 |

All these electrodes have very good performance. Samples #5 and #6 are outstanding. Heating of the rhodium oxide containing electrode #53 in nitrogen-hydrogen improved the performance compared to #27 which was heated in ammonia-air. The similar electrode #31 baked in air had slightly lower lifetimes in the accelerated tests but an excellent lifetime of 85 hours in the current reversal test in brine.

EXAMPLE 2

Further electrodes were prepared with the same total content of subsequently-applied additional catalyst (1.5 g Rh and 3.5 g Pd) as sample #1 of Example 1 but varying other parameters. Comparative electrodes with the same overall catalyst loading were also prepared. These electrodes were subjected to the same tests and the results are shown in Table 2.

TABLE 2

| | Modifications | Accelerated Life (hours) | | Current Reverse (hours) | | Half-Cell Potential (vs NHE) | |
|---|---|---|---|---|---|---|---|
| Ref. | | $H_2SO_4$ | NaOH | $H_2SO_4$ | NaCl | $O_2$ | $Cl_2$ |
| #1 | — | 270 | 84 | 8 | 15 | 1600 | 1320 |
| #7 | Ti Substrate oxidized | 316 | 70 | 10 | 34 | 1600 | 1320 |
| #8 | No linalool | 276 | 103 | 9 | 14 | 1650 | 1330 |
| #10 | No linalool Air bake | 70 | 91 | 8 | 48 | 1660 | 1330 |
| #3 | Air bake | 112 | 90 | 8 | 24 | 1630 | 1330 |
| #11 | 3 hr 500° C. | 216 | 99 | 12 | 43 | 1600 | 1320 |
| #12 | 6 hr 500° C. | 323 | 81 | 8 | 46 | 1610 | 1310 |
| #14 | 90 hr 500° C. | 400 | 98 | 9 | 42 | 1550 | 1320 |
| #58 | +0.5 g Ti | 65 | 87 | 6 | 60 | 1710 | 1320 |
| #59 | $RuO_2/TiO_2$ 15/85 | 217 | 64 | 18 | 49 | 1720 | 1340 |
| #61 | Rh/Pd 0.6/1.4 | 75 | 30 | 10 | 18 | 1660 | 1320 |
| #C1 | $RuO_2/TiO_2$ No Rh/Pd | 22 | 8 | 2.5 | 17 | 1520 | 1330 |
| #C2 | 13 g Rh/Pd No $RuO_2/TiO_2$ | 1.75 | 85 | 1 | 3.5 | 1740 | 1310 |
| #C3 | mixed Rh/Pd/Ti | 4 | 3 | 0.25 | 0.25 | 4750 | 2340 |
| #C4 | mixed Ru/Rh/Pd/Ti | 52 | 64 | 1.5 | 6 | 1540 | 1320 |

By subjecting the titanium substrate of the electrode #7 to a pre-heat treatment at 500° C. in air for 20 hours, the acid lifetime was increased to 316 hours. For sample #8, the reducing agent linalool was omitted from the activating solution and the overall performance of the electrode improved marginally over sample #1. For sample #10, linalool was also omitted and conversion of the Rh/Pd solution was done in air instead of in air/ammonia. The resulting electrode had a poor acid lifetime. For sample #3, conversion was carried out in air instead of air/ammonia. In this case, the accelerated acid lifetime was 112 hours. Thus, for this catalyst combination it is evidently very beneficial to deposit the Rh/Pd in a reduced or partially oxidized state and follow this by an oxidizing/annealing treatment.

Samples #11, #12 and #14 were subjected to post heat treatments in air at 500° C. for different durations. Sample #11 with a 3 hour treatment demonstrates quite good performance. Sample #14 with a 90 hour treatment has an excellent lifetime in the accelerated acid test.

The subsequently-applied additional catalyst of sample #58 consisted of codeposited rhodium/palladium/-titanium oxides containing 1.5 g Rh, 3.5 g Pd and 0.5 g Ti, obtained by including butyl titanate in the solution. This considerably decreased the acid lifetime and increased the oxygen-evolution potential compared to #1. The lifetime in the current reverse test in brine was good.

In sample #59, the mol ratio of ruthenium oxide to titanium oxide in the matrix was adjusted to 15/85. This electrode has good all round performance with a high oxygen evolution potential which makes it useful in processes where oxygen evolution is undesirable, for example chlorine or chlorate production.

The results for sample #61 show a comparatively good performance with a lower precious metal loading of 2 g Rh/Pd +8 g Ru instead of 5 g Rh/Pd+8 g Ru for #1.

#C1, #C2, #C3 and #C4 are comparative electrodes. For #C1, the electrode coating consisted solely of the ruthenium-titanium oxide material in an amount corresponding to 13 g/m$^2$ of Ru, i.e. the same total precious metal loading as in #1. The results shown are for an electrode without the postbake. However, it was found that the postbake in air at 500° C. for 20 hours did not materially improve this electrode; the accelerated lifetime in acid increased by only 2 hours to 24 hours.

The coating of comparative electrode #2 consisted solely of rhodium-palladium oxide deposited on the titanium substrate under the same conditions but without the ruthenium-titanium oxide matrix. Again, for the purposes of comparison, the precious metal loading was 13 g/m$^2$ (3.9 g Rh and 9.1 g Pd). For this electrode, the accelerated lifetime in the acid test was a meager 1.75 hours. This lifetime was increased to 6 hours by baking in air instead of ammonia-air.

Comparative electrode #C3 likewise had a coating deposited directly on the titanium substrate without the ruthenium-titanium oxide matrix. This coating was composed of palladium-rhodium-titanium oxide in a mol ratio palladium-rhodium oxide: titanium oxide of 30:70 and was codeposited from a mixed solution. The coating contained 3.9 g Rh and 9.1 g Pd. The lifetime in the accelerated acid test was only 4 hours and the oxygen and chlorine evolution potentials were very high.

Comparative electrode #C4 had a coating produced from a solution in which all of components (Ru/Rh/Pd-/Ti) were mixed, each metal in the codeposited multicomponent coating being present in a corresponding amount to the same metals in the matrix and in the additional catalyst of #1. The baking necessarily had to be in air. Attempts were to produce the mixed-solution multicomponent coating in a reducing atmosphere, but no adherent coating could be obtained. The resulting electrode is an improvement over the standard electrode #C1 but the improvement is largely offset by increased cost. Furthermore, inconsistent results have been obtained with these multicomponent coatings from mixed solutions. Some good results have been obtained but are difficult to reproduce.

Also, it is to be noted that the electrodes according to the invention all have a lifetime in caustic which is a multiple of that of the prior art reference electrode #C1, e.g. thirteen times as long for electrodes #5 , (Table 1) and #8 (Table 2). This makes these electrodes of the invention excellently suited for service in membrane electrolyzers wherein the anode coatings must be resistant to the effects of caustic (e.g. NaOH) which may result from contact of the anodes against the membrane, from cell shut down and from rupture of the membrane.

EXAMPLE 3

A further electrode was prepared with the same quantity of subsequently-applied additional catalyst (4 g Rh and 1 g Pd) as sample #6 of Example 1 but incorporated in a matrix of ruthenium-tin oxide. This porous matrix was prepared in the same manner as the matrix of Example 1 but using a solution of 9.2 ml n-propanol, 0.4 ml HCl (concentrated), 2.02 g $SnCl_2$ and 1 g $RuCl_3$. A well performing electrode was obtained having lifetimes of 192 hours and 96 hours in the accelerated acid and caustic tests. Lifetimes in the current reverse tests were 2.5 hours in acid and 5.5 hours in brine. The half-cell potentials were 1580 mV for oxygen evolution and 1310 mV for chlorine evolution. The overall performance was therefore good, but not as good as the corresponding sample #6 with the ruthenium-titanium oxide matrix.

EXAMPLE 4

Further electrodes were prepared in the same manner as in Example 1 but varying the additional catalyst combinations. These electrodes were subjected to the same tests and the results are shown in Table 3.

TABLE 3

| | | Accelerated Life | | Current Reverse | | Half-Cell Potential | |
|---|---|---|---|---|---|---|---|
| | Added | (hours) | | | | (vs NHE) | |
| Ref. | Catalysts | $H_2SO_4$ | NaOH | $H_2SO_4$ | NaCl | $O_2$ | $Cl_2$ |
| #17 | Ru/Pd 3.5/1.5 | 98 | 83 | 6 | 14 | 1490 | 1330 |
| #28 | Ru/Rh ¼ | 325 | 91 | 15 | 35 | 1620 | 1320 |
| #24 | Ru/Pd/Ir 4/0.5/0.5 | 590 | 105 | 6 | 8 | 1610 | 1325 |
| #22 | Rh/Pd/Ir 4/0.5/0.5 | 605 | 88 | 10 | 19 | 1600 | 1330 |
| #33 | Rh/Pt 4.75/0.25 | 352 | 106 | 14 | 53 | 1660 | 1330 |
| #5P | Ir/Pt 1.5/3.5 | 245 | 27 | 31 | 22 | 1580 | 1330 |
| #12P | Rh/Pd/Pt 0.5/4/0.5 | 240 | 84 | 7 | 38 | 1640 | 1320 |
| #22P | Pt 5 | 85 | 21 | 6 | 15 | 1570 | 1320 |

Sample #17 illustrates the role of ruthenium as a diluent for the palladium catalyst. The performance of this electrode is comparable to sample #54 of Table 1 which contained 5 g of palladium. Furthermore, sample #17 has a low oxygen evolution potential of 1490 mV making this electrode advantageous for oxygen-evolving applications.

Sample #28 shows a similar effect of ruthenium as diluent for rhodium (compare with sample #27 of Table 1) but in this case the lifetime in the accelerated acid test is increased by 100 hours to the excellent value of 325 hours.

Both of the ternary catalyst combinations of samples #24 and #22 give excellent all-round results with exceptionally long lives in the accelerated acid test. Sample #24 is particularly remarkable in view of the fact that the auxiliary catalyst consists predominantly (80%) of ruthenium with only modest amounts of palladium and iridium.

Sample #33 in which the auxiliary catalyst is platinum/rhodium oxide has good all-round performance and very good performance in the current reverse test in brine.

Sample #5P (which was produced with baking in air instead of ammonia air) is extraordinary in that it combines the long acid lifetime of $IrO_2/Pt$ with a relatively low oxygen evolution potential (100-150 mV below that of $IrO_2/Pt$ alone, depending on the baking conditions of the $IrO_2/Pt$ coating). It also has a very good lifetime in the current reverse test in $H_2SO_4$. This is therefore an excellent anode for use in oxygen evolving conditions, e.g. for metal electrowinning or as an anode for impressed-current cathodic protection.

Sample #22P is also extraordinary in that, compared to a corresponding electrode coated with 5 g of platinum (i.e. without the matrix), it has a much longer lifetime and an oxygen evolution potential which is 250–350 mV lower.

EXAMPLE 5

A titanium-based electrode was prepared with a ruthenium-titanium oxide matrix containing 9 g/m$^2$ of Ru and impregnated with iridium oxide as additional catalyst in an amount of 2 g Ir/m$^2$. The additional catalyst was deposited from a solution containing approximately 0.1 g iridium chloride, 6 ml butanol and 0.4 ml HCl (concentrated). In all, twenty-four coats were applied to produce the matrix and additional catalyst of the composite coating. To test its suitability for use mainly in hypochlorite electrolysis, the electrode was subjected to periodic current reversal in a 120 g/l solution of sodium sulphate at a current density of 4650 A/m$^2$ In a three minute reversal test the lifetime was 88 hours and in a three hour reversal test it was 246 hours.

In order to achieve comparable lifetimes with a coating of ruthenium-titanium oxide only, it is necessary to provide a coating containing about 30 g/m$^2$ of ruthenium requiring the application of about 35 layers. Such an electrode is therefore more expensive in terms of its catalyst cost and also has a substantially greater manufacturing cost.

EXAMPLE 6

Titanium sponge particles were degreased in a 50/50 vol % mixture of acetone and carbon tetrachloride. The particles were then mixed with a solution of 15.6 ml propyl alcohol, 0.4 ml HCl (concentrated), 3.2 ml butyl titanate and 1 g $RuCl_3.H_2O$(40% Ru) in a ratio of 1 g of the particles for 0.5 ml of the solution. The sponge particles were then dried by heating in air in three stages, at 80° C., 150° C. and 250° C. and, after drying, heat treated in air at 500° C. for 15 minutes. This produced a ruthenium-titanium oxide mixed crystal matrix on the sponge particles in an amount corresponding to about 8 g ruthenium per 700 g of the titanium sponge particles.

1 g of the mixed-crystal coated particles were then mixed with 0.5 ml of a solution made up of 0.65 g rhodium chloride, 0.1 g of palladium chloride, 10 ml propyl alcohol, 10 ml linalool and 0.4 ml HCl. The sponge was then dried at 100° C. followed by a heat treatment at 500° C. in an ammonia-air mixture for 30 minutes. This produces a separate phase of rhodium-palladium approximately 80–20 weight percent in the ruthenium-titanium oxide matrix. The thus treated sponge is then post heat treated at 500° C. in air for 20 hours to fully oxidise the palladium-rhodium.

This surface-activated sponge may then for example be into a lead substrate as disclosed in U.S. Pat. No. 4,425,217. When 700 g of the sponge is pressed into 1 m$^2$ of the lead surface, this corresponds to about 5 g of the rhodium/palladium per square meter of the electrode surface.

EXAMPLE 7

Titanium sponge particles were coated with a ruthenium-titanium oxide porous matrix which was impregnated with an iridium oxide additional catalyst in a similar manner to the procedure of Example 6 except that the baking was in air and there was no post heating. Various catalyst loadings were provided and comparative coatings without the iridium oxide additional catalyst were also provided as shown in Table 4. The particles were then pressed into a lead substrate as disclosed in U.S. Pat. No. 4,425,217 and the catalyzed lead electrodes were subjected to an accelerated lifetime test as oxygen evolving anodes in 150 g/l $H_2SO_4$ at 50° C. The lifetimes given in Table 4 are in days on line (DOL).

TABLE 4

| CATALYST LOADING | | |
|---|---|---|
| MATRIX Ru g/m$^2$ | AUXILIARY Ir g/m$^2$ | DOL |
| 8 | 1 | 7 |
| 8 | 0 | 4 |
| 12 | 1 | 9 |
| 12 | 0 | 6 |
| 16 | 1 | 19 |
| 16 | 0 | 11 |
| 24 | 1 | 26 |
| 24 | 0 | 13 |

It can be seen from this Table that addition of a small quantity of iridium oxide as subsequently-applied additional catalyst increases the lifetime by 50% to 100%. Similar results were obtained when the ruthenium-titanium oxide matrix on the sponge particles had a mol ratio of approximately 1:1 instead of 1:2.

EXAMPLE 8

A titanium mesh pickled in hot hydrochloric acid for 1 hour was rinsed with water, dried in air and coated with a solution of 6.2 ml butyl alcohol, 0.4 ml HCl 36%, 3 ml butyl titanate, and 1 g $RuCl_3H_2O$ (40% Ru).

In all, eight coats were applied, each coat being heated in air at 500° C. for ten minutes. The resulting electrode had a coating of ruthenium oxide coprecipitated with titanium oxide in a molar ratio of 30% $RuO_2$:70% $TiO_2$ and an overall loading of 8 g Ru/m$^2$.

This anode which had been in operation for several years in a chlor-alkali diaphragm cell was removed due to the transformation of the cell to the ion exchange membrane process. Due to the more severe operating conditions in these membrane cells it is not advisable to reinstall the used anodes or to topcoat them with the same $RuO_2.TiO_2$ coating previously used because this might not provide the desired improved performance and corrosion resistance. For this reason the diaphragm cell anode coating is modified as follows:

After removal from the diaphragm cells, the electrodes are cleaned to remove any alien material with high pressure water and mild etching in HCl 15% for 10 minutes. The porous mixed crystal coating ($RuO_2.TiO_2$) is impregnated with a rhodium and palladium chloride containing solution as described in Example 1 and submitted to the same heat treatment so as to disperse throughout the ruthenium-titanium dioxide matrix a rhodium oxide and palladium oxide phase in an amount corresponding to 4 g/m$^2$ of Rh and 1 g/m$_2$ of Pd. The resulting anode coating has outstanding performance as compared with standard mixed metal oxide coatings in membrane electrolyzers, with high resistance to caustic brine, improved selectivity for chlorine evolution (inhibition of unwanted oxygen) and high corrosion resistance.

We claim:

1. A porous high surface area composite electroconductive catalytic material, comprising a porous high surface area pre-formed host matrix and a subsequently-applied impregnated catalyst supported by and distributed in the preformed host matrix, the composite catalytic material having an outer face which in use is in contact with a fluid medium, wherein the porous host matrix is a catalytic material comprising at least one platinum-group metal oxide and at least one non-precious metal oxide mixed intimately in a porous high surface area matrix structure and said subsequently-applied impregnated catalyst consists of at least one platinum-group metal, or at least one platinum-group metal oxide, or mixture thereof.

2. The catalytic material of claim 1, wherein the porous matrix consists essentially of a mixed crystal material of rutile structure.

3. The catalytic material of claim 2, wherein the porous matrix is a mixed crystal coating keyed to the surface of a valve metal base, and the applied platinum-group metal, or at least one platinum-group metal oxide, or mixture thereof is incorporated in this coating.

4. The catalytic material of claim 3, wherein the porous matrix is a ruthenium-titanium oxide mixed crystal on a valve metal base.

5. The catalytic material of claim 1, 2, 3 or 4, wherein the subsequently-applied catalyst is platinum metal or an oxide of rhodium, palladium or iridium.

6. The catalytic material of claim 1, 2, 3 or 4, wherein the subsequently-applied catalyst comprises platinum metal mixed with at least one oxide of ruthenium, rhodium, palladium, and iridium.

7. The catalytic material of claim 1, 2, 3 or 4, wherein the subsequently-applied catalyst comprises at least two oxides of ruthenium, rhodium, palladium, and iridium.

8. A porous high surface area composite electroconductive catalytic material comprising a porous preformed matrix on the surface of a valve metal base and a subsequently-applied catalyst dispersed throughout the porous matrix, the composite catalytic material having an outer face which in use is in contact with a fluid medium, characterized in that the porous matrix is a catalytic mixed crystal material comprising at least one platinum-group metal oxide and at least one co-formed non-precious metal oxide forming a porous high surface area coating on the valve metal base, the subsequently-applied catalyst being dispersed in this structure by chemideposition from at least one thermodecomposable platinum-group metal compound followed by annealing whereby both (a) the platinum-group metal oxide of the preformed matrix and (b) the subsequently-applied catalyst disposed inside the matrix structure are exposed through the pores of the composite electrocatalytic material to the medium contacting the outer face of the composite caatalytic material and wherein the subsequently-applied catalyst consists of at least one platinum-group, or at least one platinum-group metal oxide, or mixture thereof.

9. A porous high surface area composite electroconductive catalytic material comprising a porous preformed catalytic matrix and a subsequently-applied additional catalyst dispersed throughout and supported by the preformed matrix, characterized in that:

(a) the preformed matrix is a mixed catalytic material comprising at least one platinum-group metal oxide mixed intimately with at least one non-precious metal oxide in a porous high surface area support structure;

(b) the subsequently-applied additional catalyst is a modifier catalyst which is of different composition to the mixed catalytic material of the preformed matrix; and (c) the subsequently-applied additional catalyst is carried by the preformed matrix as a thin discontinuous layer non-uniformly distributed in the porous high surface area support structure.

10. The catalytic material of claim 9, wherein the porous matrix consists of a mixed-crystal material in which the non-precius metal oxide is present in an amount of at least 50 mol % and the subsequently-applied additional catalyst contains at least 90% by weight of catalytic material.

11. The catalytic material of claim 10, wherein the additional catalyst consists of at least one platinum group metal at least one platinum group metal oxide, or mixtures thereof with at least one catalytic non-precious metal oxide.

12. A method of producing the composite electroconductive catalytic material of claim 1, comprising:

(a) providing a preformed porous matrix which is a catalytic material comprising at least one platinum-group metal oxide and at least one non-precious metal oxide mixed intimately in a porous high surface area structure;

(b) impregnating the porous matrix with an essentially non-precious metal free solution containing at least one thermodecomposable platinum-group metal compound; and (c) heat treating the impregnated porous matrix to convert the compound(s) to at least one platinum-group metal or at least one platinum-group oxide, or mixture thereof, dispersed throughout the porous matrix.

13. A method of producing the composite electrocatalytic material of claim 9, comprising:

(a) providing a preformed porous matrix which is a mixed catalytic material comprising at least one platinum-group metal oxide mixed intimately with at least one-precious metal oxide in a porous high surface area support structure;

(b) impregnating the porous matrix with a solution containing compounds decomposable to form a modified catalyst of different composition to the mixed catalytic material of the preformed matrix, the modifier catalyst containing at least 90% by weight of catalytic material; and (c) heat treating the impregnated porous matrix to convert the compounds to said modifier catalyst dispersed throughout the porous matrix.

14. The method of claim 12 or 13, wherein the heat treatment takes place in an oxidizing atmosphere.

15. The method of claim 12 or 13, wherein the heat treatment takes place in a non-oxidizing or partially oxidizing atmosphere.

16. The method of claim 12 or 13, wherein the heat treatment is completed by annealing in air at a temperature of from 300° to 600° C. for up to 100 hours.

17. The method of claim 12 or 13, wherein the porous matrix is formed by codepositing thermally decomposable platinum-group metal and non-precious metal compounds in an oxidizing atmosphere onto a valve metal base.

18. The method of any one of claims to 12 or 13, wherein the porous matrix consists of a used electrocatalytic coating of a dimensionally stable electrolysis electrode.

19. A catalytic electrolysis electrode comprising as electrocatalyst the catalytic material of any one of claims 1 or 8.

20. A catalytic electrolysis electrode comprising as electrocatalyst the catalytic material produced by the method of any one of claims 12 or 13.

* * * * *

UNITED STATES PATENT AND TRADEMARK OFFICE

CERTIFICATE OF CORRECTION

PATENT NO. : 4,585,540

DATED : April 29, 1986

INVENTOR(S) : Beer, et al.

It is certified that error appears in the above-identified patent and that said Letters Patent are hereby corrected as shown below:

In the Cover Page:

Left hand column, after "[22]"cancel "Filed: Jan. 7, 1985" and insert:

PCT Filed: September 17, 1984

[86] PCT No.: PCT/EP84/00285

§371 Date: Jan. 7, 1985

§102(e) Date: Jan. 7, 1985

[87] PCT Pub. No.: WO 86/01839

PCT Pub. Date: March 27, 1986

Column 1, Line 25, after "U.S. Pat. Nos." change "3,771,385" to ---3,711,385--.

Claim 11,line 3, after "group metal" insert --,--.

Signed and Sealed this

Seventh Day of October, 1986

[SEAL]

*Attest:*

DONALD J. QUIGG

*Attesting Officer*

*Commissioner of Patents and Trademarks*